United States Patent [19]

Hannemann

[11] Patent Number: 4,819,846

[45] Date of Patent: Apr. 11, 1989

[54] SPORTSMAN'S BELT HAVING A PLURALITY OF POCKETS

[76] Inventor: Nils Hannemann, 89 Eastbourne, Carlswald, Midrand 1685, Transvaal Province, South Africa

[21] Appl. No.: 51,408

[22] Filed: May 19, 1987

[30] Foreign Application Priority Data

May 19, 1986 [ZA] South Africa ..... 86/3694

[51] Int. Cl.[4] ..... A45F 3/00

[52] U.S. Cl. ..... 224/240; 224/901; 224/223; 224/241; 2/312

[58] Field of Search ..... 224/901, 240, 241, 235, 224/236, 904, 227, 228, 229, 222, 223, 224, 226; 2/300, 311, 312, DIG. 6, 247, 250, 252, 254; 24/3 R, 31 V, 442, 306

[56] References Cited

U.S. PATENT DOCUMENTS

| | | | |
|---|---|---|---|
| D. 104,572 | 5/1937 | Lewis | 224/236 X |
| 860,592 | 7/1907 | Batchelder | 224/228 X |
| 1,306,243 | 6/1919 | Achtmeyer | 224/228 |
| 1,382,446 | 6/1921 | Warren | 2/311 |
| 1,801,161 | 4/1931 | Itkowitz et al. | 2/300 |
| 2,019,248 | 10/1935 | Blumgardt | 2/312 X |
| 2,286,525 | 6/1942 | Woodward | 2/312 X |
| 2,324,194 | 7/1943 | Campiglia | 224/236 X |
| 2,353,567 | 7/1944 | Key | 2/311 |
| 3,374,636 | 3/1968 | Mason | 224/901 X |
| 3,664,560 | 5/1972 | Perkins | 224/226 |
| 3,919,615 | 11/1975 | Niecke | 224/227 X |
| 4,047,650 | 9/1977 | Domingos | 224/236 X |
| 4,139,133 | 2/1979 | Repka | 224/901 X |
| 4,322,024 | 3/1982 | Kelly | 224/224 |
| 4,440,525 | 4/1984 | Perla | 224/229 X |
| 4,479,596 | 10/1984 | Swanson | 224/236 |
| 4,569,465 | 2/1986 | O'Farrell | 224/224 |

*Primary Examiner*—Ernest G. Cusick

*Attorney, Agent, or Firm*—Fleit, Jacobson, Cohn & Price

[57] ABSTRACT

An article of sportsman's equipment for use by sportsmen engaged in endurance oriented activities such as marathons, etc., is provided in which a plurality, generally from four to eight pouches for nutrients are provided on a belt. The belt and pouches are made of flexible sheet material having a weight of not more than 7.5 ounces/sq.yd. and preferably from about 1.75 to about 6.0 ounces/sq.yd.

3 Claims, 1 Drawing Sheet

SPORTSMAN'S BELT HAVING A PLURALITY OF POCKETS

FIELD OF THE INVENTION

This invention relates to sportman's equipment and, more particularly, to equipment for use by a sportsman engaged in endurance orientated activities such as long distance running, skiing, board sailing, walking, cycling and canoeing or the like.

BACKGROUND TO THE INVENTION

Sportsmen engaged in endurance orientated activities, such as long distance running, for example, need to consume nutrients for the purpose of replacing or providing energy at intervals of time during such endurance orientated activities. Thus, such sportsmen may consume concentrated nutrients together with water or other water-based drinks at various points during the carrying out of the endurance orientated activity. Such nutrients have to be conveyed to the points at which they are taken and it is the object of this invention to provide a particularly useful or convenient article of sportsman's equipment designed particularly for the purpose of conveying such nutrients.

SUMMARY OF THE INVENTION

In accordance with this invention there is provided an article of sportsman's equipment comprising a belt made of flexible sheet material and carrying thereon at leat two spaced, closable pouches adapted for receiving packages of nutrients or the like therein, the pouches also being made of flexible sheet material and wherein both the flexible sheet material from which the belt and pouches is made weighs less than about 7.5 ounces/sq.-yard (i.e. less than 250 g/m$^2$),.

Further features of the invention provide for there to be at least four substantially symmetrically positioned pouches on the belt, and in particular, six or eight of such pouches; for at least some of said pouches to be removably carried by the belt; for each pouch to be closable by dimensioning it to fold over on itself across its length with means for releasably securing it in such position being provided on the pouch and belt; for means for releasably securing the free ends of the belt together in an operative position to be a co-operating releasably engageable mat and pad arrangement as hereinafter described; for the means for releasably closing the pouches to be similar releasably engageable mat and pad arrangements; for the flexible sheet material to be a woven cloth preferably having a weight of from about 1.75 to about 6.0 ozs/sq.yard, (i.e. from 60 to 200 g/m$^2$), and in particular less than about 3.5 and even about 2.5 ozs/sq.yard; i.e. less than about 120 and over about 85 g/m$^2$; and for an elastic zone to be embodied in the length of the belt.

In this specification the term "releasably engageable mat and pad arrangement" is intended to mean a releasable fastening device of the type having a mat composed of a carrier strip having secured to it a mass of looped fibers in which engage, in the attached positions, a multitude of hooked upstanding filaments carried by the pad. When engaged in the mat the hooked shaped elements hold the pad in engagement with the mat but excessive force can tear the two apart. One example of such a mat and pad arrangement is that sold under the proprietary trade name "Velcro".

The flexible sheet material is preferably woven and the following types of woven materials are considered to be suitable:

Nylon/Rayon material having a weight of about 1.75 ounces/sq.yd; i.e. 60 g/m$^2$ Chintz material having a weight of about 2.5 ounces/sq.yd; i.e. 85 g/m$^2$ Trilobal material having a weight of about 3.4 ounces/sq.yd; i.e. 115 g/m$^2$ 50% Polyester/cotton material having a weight of about 4.7 ounces/sq.yd; i.e. 161 g/m$^2$ and, Cotton/towelling material having a weight of about 5.75 ounces/sq.yd. i.e. 197 g/m$^2$ In order that the invention may be more fully understood, one embodiment thereof will now be described with reference to the accompanying drawing.

DETAILED DESCRIPTION OF THE PREFERRED EMBODIMENT

Figure 1:
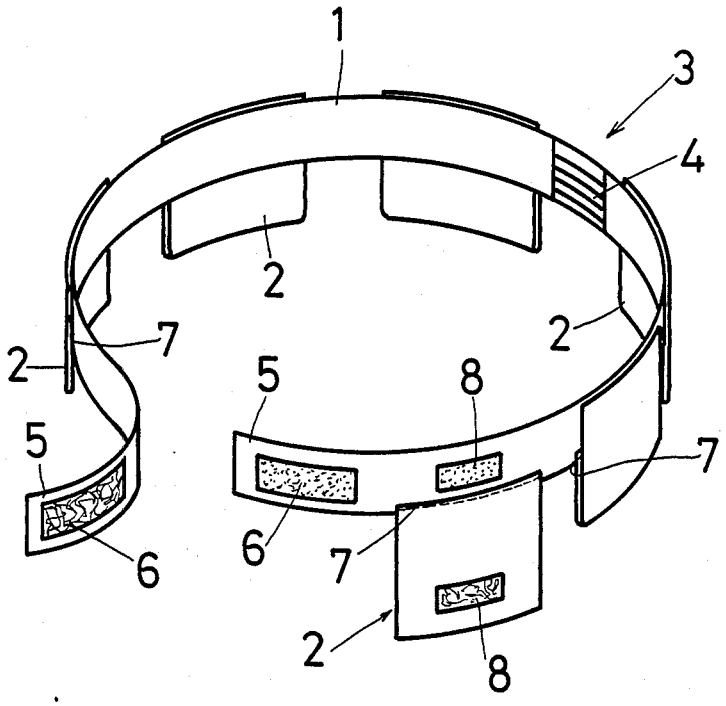
FIG. 1 is an isometric view illusrating an article of sportsman's equipment according to this invention.

In the illustrated FIG. 1 embodiment of the invention the article of sportsman's equipment comprises a belt 1 carrying a plurality of, in this case, six, pouches 2, wherein both the belt and pouches are made from a woven Trilobal fabric material having a suitable strength and a weight of about 3.4 ounches/sq.yd i.e. 115 g/m$^2$. If required, a reinforcing sheet (not shown) could be embodied within the belt to avoid unacceptable distortion or stretching of the belt in its length but such a reinforcing sheet should be extremely light so as to comply with the requirements of lightness of the composite article.

As illustrated, the belt 1 has, at a position designed to be in the central back region of a person in use, a zone 3 composed of a plurality of elastic straps 4, the purpose of which is to maintain the belt snugly in position on a sportsman during use thereof.

The free ends 5 of the belt have, one on the inside and one on the outside respectively, a strip 6 of mat and pad material (as herein defined) adapted to co-operate in use to releasably fasten the ends together in various degrees of overlapping relationship. In this manner there is provided an automatic adjustment of the circumference of the belt according to the degree of overlap of the mat and pad respectively.

Stitched to the belt, at equally spaced positions along its length, are six pouches 2 made of similar fabric material. The pouches are made to an elongate rectangular shape with the length thereof extending at right angles to the length of the belt. One end portion 7 of each pouch is stitched to the belt towards one edge thereof such that the pouch can be folded over to close it and be secured to the adjacent part of the belt by way of a mat and pad arrangement 8 (as herein defined), one part of which is secured to each of the two surfaces to be releasably attached.

The closed end of the pouch is the end most remote from the belt whilst the open end is that secured to the belt.

It will be understood that, in use, prepackaged liquid or sub-divided solid, pelletized or tabletted nutrients, generally in a concentrated form, can be placed in the pouches and the belt worn by a sportsman embarking on an endurance orientated activity such as long distance running.

Figure 2:
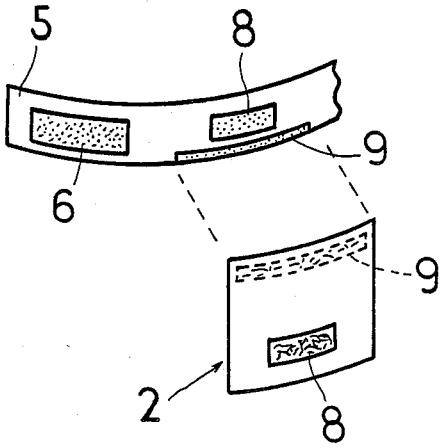
FIG. 2 is a view similar to FIG. 1 showing an alternative embodiment.

As and when required, and generally at water stops, a quantity of nutrients, generally the content of one pouch, can be removed, swallowed and any required water can be drunk. It will be understood that the number of pouches may accordingly be varied depending on the length of time for which nutrients are to be carried and, accordingly, different belts may be employed for different purposes by any particular sportsman. Alternatively, pouches may be made to be removable from the belt as shown in FIG. 2 and, to this end, they could be attached to the belt through further mat and pad assemblies 9 as above described. Alternatively, press-studs could be employed.

It will be understood that the invention provides an extremely simple but highly effective article of sportsman's equipment designed for use by sportsmen carrying out endurance orientated activities. It will also be understood that numerous variations may be made to the above described embodiment of the invention without departing from the scope hereof. In particular, the sheet material could be of a waterproof nature or may be of a non-woven type of fabric.

What I claim as new and desire to secure by Letters Patent is:

1. An article of sportman's equipment comprising a belt made of flexible sheet material for encircling a user's waist, cooperable mat and pad-type friction fastening means at opposite ends of the belt for releasably securing same around the user's waist, and at least two spaced closable pouches on the belt for receiving nutrients and the like, each pouch including a back sheet of flexible material having an upper edge portion and a lower edge portion and a front sheet of material having an upper edge portion and a lower edge portion, securing means fastening the upper edge portion of the back sheet to the belt adjacent a lower edge of the belt and cooperable attachment means on the belt above said securing means and on the lower edge portion of the front sheet of the pouch for mutual engagement of said attachment means to fold and close the pouch, and wherein the belt and pouch are each made of sheet material weighing less than 7.5 ounces/sq. yard i.e. 200 $g/m^2$.

2. An article as claimed in claim 1 wherein the attachment comprises releasable attachment means.

3. An article as defined in claim 2 wherein the attachment means are mat and pad-type attachment means.

* * * * *